US009591407B2

(12) United States Patent
Guo et al.

(10) Patent No.: US 9,591,407 B2
(45) Date of Patent: Mar. 7, 2017

(54) SPEAKER

(71) Applicants: Shun Guo, Shenzhen (CN); Hongxing Wang, Shenzhen (CN); Lubin Mao, Shenzhen (CN); Fei Hou, Shenzhen (CN)

(72) Inventors: Shun Guo, Shenzhen (CN); Hongxing Wang, Shenzhen (CN); Lubin Mao, Shenzhen (CN); Fei Hou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/832,419

(22) Filed: Aug. 21, 2015

(65) Prior Publication Data

US 2016/0198264 A1 Jul. 7, 2016

(30) Foreign Application Priority Data

Jan. 7, 2015 (CN) ..... 2015 2 0009971

(51) Int. Cl.
*H04R 25/00* (2006.01)
*H04R 9/02* (2006.01)
*H04R 7/18* (2006.01)

(52) U.S. Cl.
CPC ..... *H04R 9/02* (2013.01); *H04R 7/18* (2013.01); *H04R 2499/11* (2013.01)

(58) Field of Classification Search
CPC ..... H02K 33/16; H02K 33/06; H02K 33/00; H02K 33/12; H02K 33/18; H04R 2400/03; H04R 9/06; H04R 9/066; H04R 1/24; H04R 2460/13; H04R 2499/15; H04R 5/02; H04R 7/045; H04R 9/025; H04R 11/00; H04R 11/02; H04R 17/00; H04R 1/005
USPC .... 310/15, 25; 381/412, 150, 396, 338, 413, 381/417; 335/229
See application file for complete search history.

(56) References Cited

U.S. PATENT DOCUMENTS 4,555,645 A * 11/1985 Atkinson ..... H02K 33/18 310/13
6,761,072 B1 * 7/2004 Burns ..... B60C 23/0408 73/700
8,345,915 B2 * 1/2013 Shin ..... H04M 1/03 381/151
8,462,977 B2 * 6/2013 Wang ..... H04R 9/02 381/413

(Continued)

*Primary Examiner* — Davetta W Goins
*Assistant Examiner* — Phylesha Dabney
(74) *Attorney, Agent, or Firm* — Na Xu; IPro, PLLC

(57) ABSTRACT

The present disclosure provides an electromagnetic speaker, includes a frame having an elongated axis; a vibration unit accommodated in the frame, the vibration unit comprising a magnet assembly, the vibration unit further including a passage; a spring elastically deformable along the elongated axis and elastically suspending the magnet assembly in the frame; a guiding pole sleeved by the spring and at least partially passing through the passage for providing a guidance to the vibration unit; a voice coil fixed relative to the frame and surrounding the magnet assembly; a diaphragm driven by the vibration unit for radiating sounds. When the electromagnetic speaker is mounted in a mobile phone, the diaphragm vibrates along a direction parallel to the screen, and the amplitude thereof will not be affected by the height of the mobile phone.

9 Claims, 4 Drawing Sheets

(56) References Cited

U.S. PATENT DOCUMENTS 9,332,351 B2 * 5/2016 Porter ..... H04R 9/025

* cited by examiner

SPEAKER

FIELD OF THE INVENTION

The present invention relates to electroacoustic apparatuses, more particularly to a sound generator used in an electronic device for converting electrical signals to audible sounds.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of sound generators have been developed. A sound generator is generally coupled to an audio equipment or an amplifier for use as a large sound producing means for considerably amplifying volume. Alternatively, the sound generator may be used as a small sound producing means having a small size and volume.

An electronic device, such as a cellular phone, a camcorder, a PDA, a digital camera, or a notebook computer, provides a space for accommodating a sound generator therein. Nowadays, a sound generator with high quality audio performance and miniature size is desired.

Generally, a speaker includes a frame, a magnetic circuit positioned by the frame, and a vibration unit interacting with the magnetic circuit for producing vibrations. The magnetic circuit includes a yoke, a magnet positioned on the yoke, and a magnetic gap formed between the yoke and the magnet. The vibration unit generally includes a voice coil having an end thereof in the magnetic gap, and a diaphragm connected with the voice coil.

While electrified, the voice coil interacts with the magnetic circuit and Lorenz Force is accordingly produced. By the Lorenz Force, the voice coil is actuated to vibrate and further drives the diaphragm to vibrate. Sound waves are thus generated.

The mobile phone will be designed to have bigger and bigger screen and at the same time to have thinner and thinner height. The speaker generally includes a vibration unit vibrating along a direction perpendicular to the screen. Obviously, the vibration amplitude will be restricted by the thinner height, which will badly affect the acoustic performance.

Accordingly, an improved electromagnetic speaker enabling solving the problems mentioned above and having a greater vibration amplitude is desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
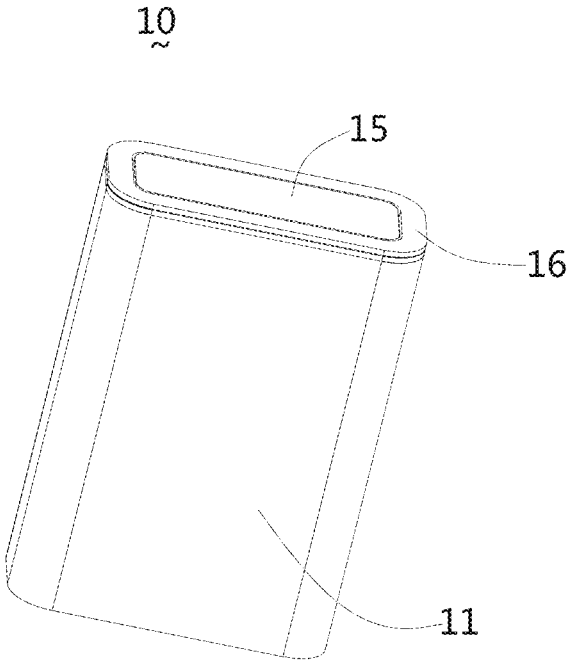
FIG. 1 is an isometric view of an electromagnetic speaker in accordance with an exemplary embodiment of the present disclosure.
Figure 2:
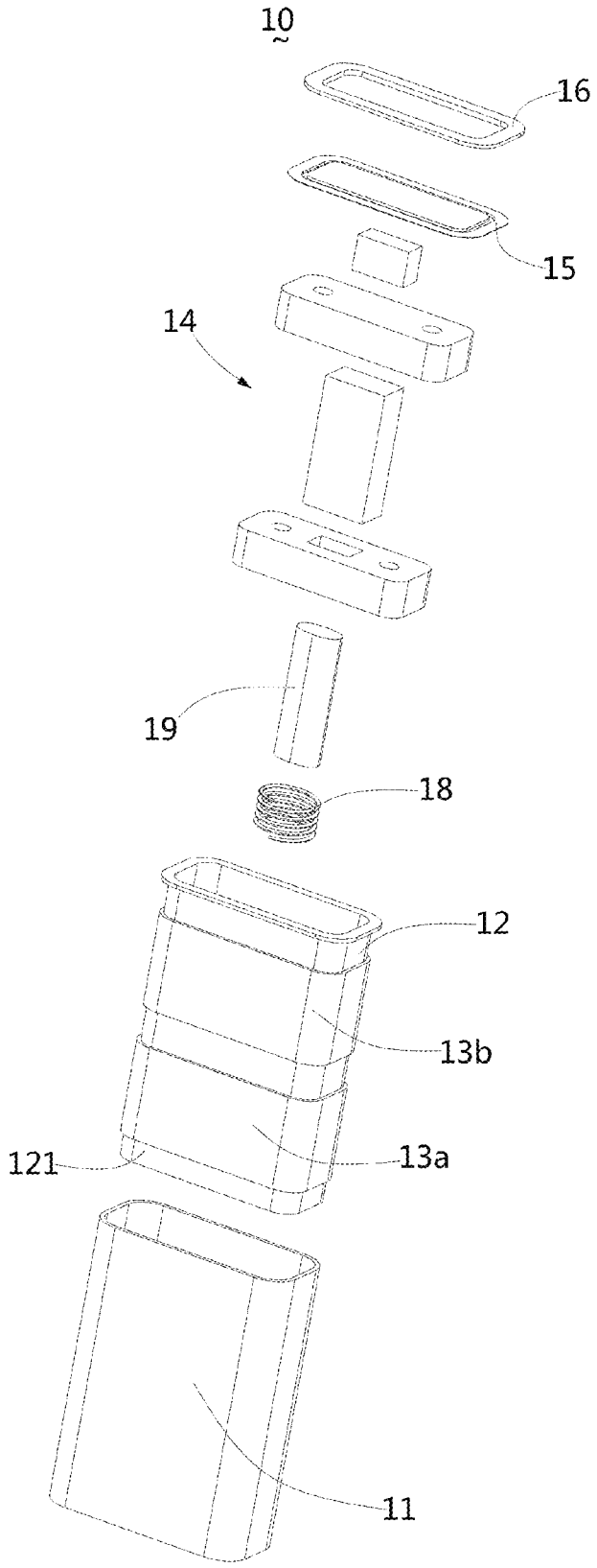
FIG. 2 is an exploded view of the electromagnetic speaker in FIG. 1.

Referring to FIGS. 1-2, an electromagnetic speaker 10 in accordance with a first exemplary embodiment of the present disclosure includes a housing 11, a frame 12 accommodated in the housing 11, a first voice coil 13*a* positioned relative to the frame 12, a second voice coil 13*b* positioned relative to the frame 12, a vibration unit 14 received in the frame 12, a diaphragm 15 connected to the vibration unit 14 directly or indirectly, and a front cover 16 pressing a periphery of the diaphragm 15. The housing 11 and the frame 12 each have an elongated axis. It is optional that the vibration unit 14, the frame 12, the first and second voice coils 13*a*, 13*b*, are all accommodated in the housing 11. The frame 12 includes a sidewall 121 forming a receiving space for receiving the vibration unit 14 therein. The first and second voice coils 13*a*, 13*b* are both attached to the sidewall 121 of the frame 12. Another word, the first and second voice coils 13*a*, 13*b* both surround the sidewall 121 of the frame 12. The electromagnetic speaker 10 further includes a spring 18 with one end thereof fixed to the frame 12, and a guiding pole 19 sleeved by the spring 18. The spring 18 is elastically deformable along the elongated axis of the frame 12 or the housing 11.

Figure 3:
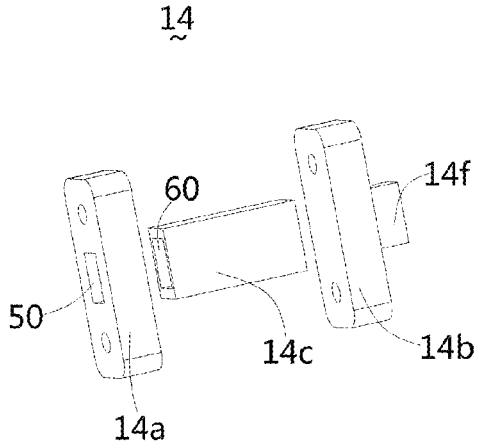
FIG. 3 is an isometric and exploded view of a vibration unit of the electromagnetic speaker in FIG. 1.

Referring to FIG. 3, an isometric and exploded view of the vibration unit 14, the vibration unit 14 includes a first magnet assembly 14*a*, a second magnet assembly 14*b*, a connecting beam 14*c* for connecting the first magnet assembly 14*a* to the second magnet assembly 14*b*, and a driving member 14*f* extending from the second magnet assembly 14*b*. The magnet assembly may comprise a magnet with a pole plate attached thereto, or only comprises a magnet without any pole plate. Therefore, the magnet assembly may be designed and configured according to actual requirements, as long as the magnet assembly could produce magnetic field. As shown in FIG. 3, the driving member 14*f* extends from the second magnet assembly 14*a*. In fact, according to actual requirements, the driving member 14*f* could be arranged on the first magnet assembly 14*a*, which is determined by the position of the diaphragm 15. In addition, the first magnet assembly 14*a* forms a through hole 50, and correspondingly, the connecting beam 14*c* forms a tunnel 60. When the connecting beam 14*c* connects with the first magnet assembly 14*a*, the through hole 50 communicates with the tunnel 60.

Figure 4:
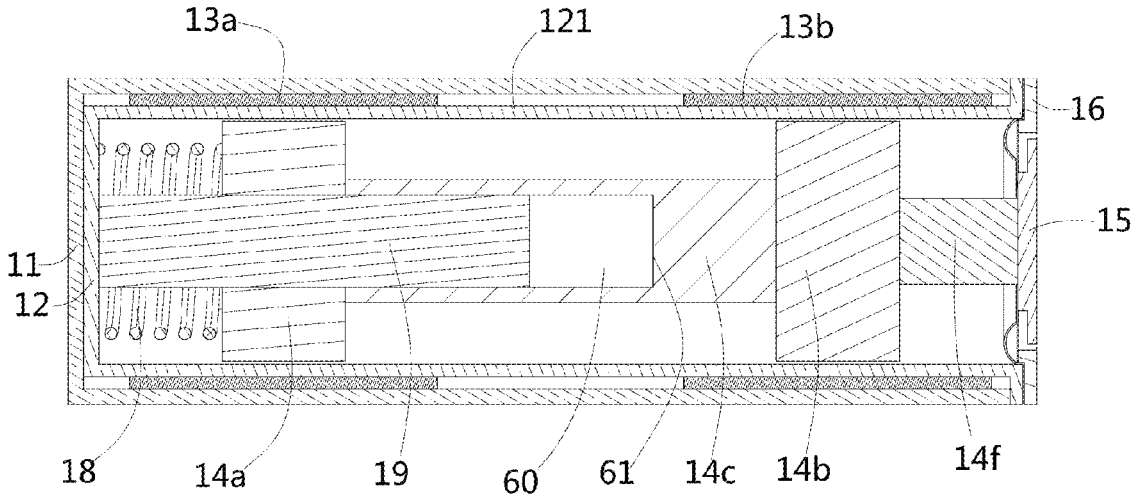
FIG. 4 is a cross-sectional view of the electromagnetic speaker in FIG. 1.

Referring to FIGS. 3-4, the frame 12 is accommodated in the housing 11. A gap is accordingly formed between the sidewall 121 and an interior side of the housing 11. The first and second voice coils 13*a*, 13*b* are received in the gap. As described above, the first and second voice coils 13*a*, 13*b* surround the sidewall 121 of the frame 12. Therefore, the first and second voice coils 13*a*, 13*b* are attached to an exterior side of the sidewall 121. The vibration unit 14 is suspended in the frame 12 by the spring 18 and the guiding pole 19. The spring 18 is deformable along a direction parallel to the elongated axis of the frame. Another word, the vibration unit 14 is capable of vibrating along a direction parallel to the sidewall 121 of the frame 12. The guiding pole 19 has an end thereof fixed to the frame 12 and is sleeved by the spring 18. The guiding pole 19 passes through the through hole 50 of the first magnet assembly 14*a*, and further enters the tunnel 60 of the connecting beam 14*c*. Thus, the vibration unit 14 could move along the elongated axis of the frame 12 by sliding along the guiding pole 19. The spring 18 will be pressed and released elastically by the movement of the vibration unit 14. The driving member 14*f* connects to the diaphragm 15 directly or indirectly. The front cover 16 presses on the periphery of the diaphragm 15 for fixing the diaphragm 15 to the frame 12 or the housing 11. By virtue of the configurations described above, as the voice coils 13*a*, 13*b* surround the first and second magnet assemblies 14*a*, 14*b* respectively, the magnetic field lines produced by the first and second magnet assemblies 14*a*, 14*b* pass through the voice coils 13*a*, 13*b* perpendicularly. When the voice coils 13*a*, 13*b* are electrified, Lorenz Force will be accordingly produced. Because the voice coils 13*a*, 13*b* are fixed by the frame 12, the voice coils 13*a*, 13*b* cannot move. By the reaction, the first and second magnet assemblies 14*a*, 14*b* will be actuated to move. The movement of the first and second magnet assemblies 14*a*, 14*b* is transferred to the diaphragm 15 via the driving member 14*f*. Vibration of the diaphragm 15 produces and radiates sounds.

By virtue of the configuration mentioned above, the electromagnetic speaker has a small form with a reduced height. Further, greater driving force is generated by the magnet assemblies driving the diaphragm. When the electromagnetic speaker is mounted in a mobile phone, the diaphragm vibrates along a direction parallel to the screen, and the amplitude thereof will not be affected by the height of the mobile phone. In fact, the amplitude of the diaphragm at low frequency is greater than a normal speaker.

Figure 5:
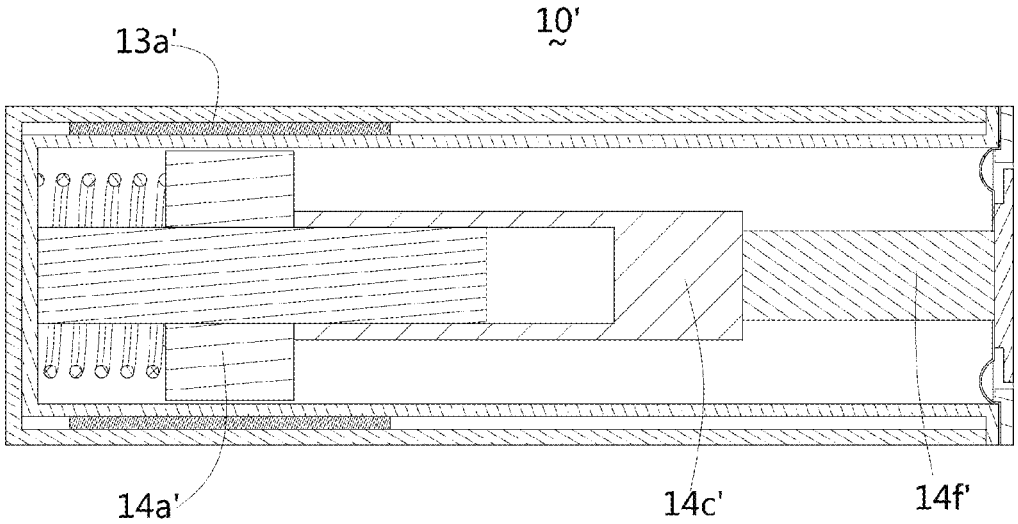
FIG. 5 is a cross-sectional view of an electromagnetic speaker in accordance with a second embodiment of the present disclosure.

Referring to FIG. 5, a cross-sectional view of an electromagnetic speaker 10' of a second embodiment, what is different from the first embodiment is that the speaker 10' only includes one magnet assembly 14*a*'. And accordingly, only one voice coil 13*a*' is provided to surround the magnet assembly 14*a*'. The driving member 14*f*' is arranged on the connecting beam 14*c*'. In fact, the driving member 14*f*' could be arranged on any part of the vibration unit. The driving member is indeed a medium to transfer the vibration of the vibration unit to the diaphragm.

Figure 6:
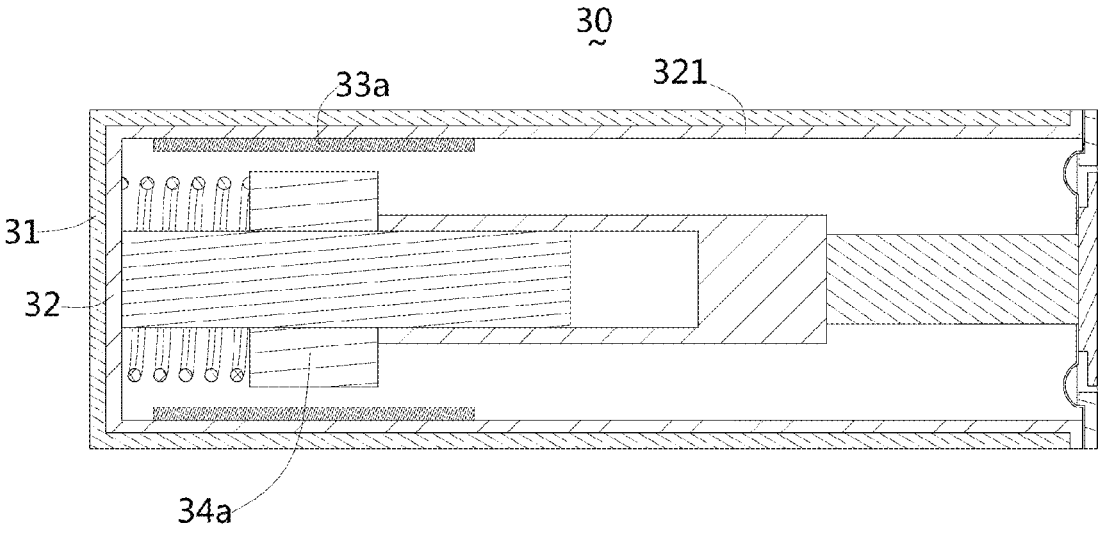
FIG. 6 is a cross-sectional view of an electromagnetic speaker in accordance with a third embodiment of the present disclosure.

Referring to FIG. 6, a cross-sectional view of an electromagnetic speaker 30 of a third embodiment, what is different from the first embodiment is that the voice coil 33*a* is positioned on the inside of the sidewall 321 of the frame 32. That is, the sidewall 321 locates between the housing 31 and the voice coil 33*a*. In fact, the voice coil 33*a* is located between the sidewall 321 and the magnet assembly 34*a*.

Kindly be noted that the frame and the housing could exist together, or only the frame exists, or only the housing exists. The housing and the frame are used to assemble other components firmly and stably. Without the frame, the structures originally formed on the frame could be directly formed on the housing. For example, the sidewall could be directly formed on the housing. In this case, the housing is indeed the frame. Without the housing, the embodiment is still workable.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electromagnetic speaker, comprising:

a frame having an elongated axis;

a vibration unit accommodated in the frame, the vibration unit comprising a magnet assembly, the vibration unit further including a passage;

a spring elastically deformable along the elongated axis and elastically suspending the magnet assembly in the frame;

a guiding pole sleeved by the spring and at least partially passing through the passage for providing a guidance to the vibration unit; the vibration unit movable along the elongated axis of the frame by sliding along the guiding pole;

a voice coil fixed relative to the frame and surrounding the magnet assembly, the voice coil keeping a distance from the magnet assembly;

a diaphragm in contact with the vibration unit, and driven by the movement of the magnet assembly along the elongated axis of the frame for producing and radiating sounds along a direction parallel to the guiding pole.

2. The electromagnetic speaker as described in claim 1, wherein the magnet assembly comprises a first magnet assembly and a second magnet assembly, and the vibration unit further includes a connecting beam for connecting the first magnet assembly to the second magnet assembly.

3. The electromagnetic speaker as described in claim 1, wherein the voice coil further includes a first voice coil surrounding the first magnet assembly, and a second voice coil surrounding the second magnet assembly.

4. The electromagnetic speaker as described in claim 2, wherein the first magnet assembly includes a through hole, and the connecting beam forms a tunnel, the through hole and the tunnel cooperatively form the passage.

5. The electromagnetic speaker as described in claim 1 further comprising a driving member extending from the vibration unit for connecting to the diaphragm.

6. The electromagnetic speaker as described in claim 1, wherein the frame includes a sidewall forming a space for accommodating the vibration unit therein, and the voice coil is fixed to the sidewall so that the sidewall is located between the voice coil and the magnet assembly.

7. The electromagnetic speaker as described in claim 1, wherein the frame includes a sidewall forming a space for accommodating the vibration unit therein, and the voice coil is fixed to the sidewall so that the voice coil is located between the sidewall and the magnet assembly.

8. The electromagnetic speaker as described in claim 1 further including a housing providing a space for accommodating the frame therein.

9. The electromagnetic speaker as described in claim 1 further including a front cover for pressing a periphery of the diaphragm.

* * * * *